US005778605A

United States Patent [19]

Ellena et al.

[11] Patent Number: 5,778,605

[45] Date of Patent: Jul. 14, 1998

[54] GLIDE CAP FOR WALKER

[75] Inventors: Nate Ellena, Woodland Hills; Rolf Orchard, Manhattan Beach, both of Calif.

[73] Assignee: Sunrise Medical HHG, Inc., Longmont, Colo.

[21] Appl. No.: 728,889

[22] Filed: Oct. 10, 1996

[51] Int. Cl.[6] ..... A45B 9/04

[52] U.S. Cl. ..... 135/78; 135/77; 135/82; 135/86

[58] Field of Search ..... 135/77, 78, 82, 135/86; 248/188.9, 688, 687

[56] References Cited

U.S. PATENT DOCUMENTS

| | | | |
|---|---|---|---|
| 960,700 | 6/1910 | Pratt . | |
| 1,504,902 | 8/1924 | Rosenhein, Jr. . | |
| 1,898,309 | 2/1933 | Noelting | 248/188.9 |
| 2,419,105 | 4/1947 | Allan . | |
| 2,878,509 | 3/1959 | Fisher . | |
| 2,994,152 | 8/1961 | Donahue | 135/77 X |
| 3,467,117 | 9/1969 | Lucibello . | |
| 3,741,226 | 6/1973 | Urban | 135/86 X |
| 4,094,330 | 6/1978 | Jong . | |
| 4,899,771 | 2/1990 | Wilkinson . | |
| 4,995,412 | 2/1991 | Hirn et al. | 135/77 X |
| 5,032,135 | 7/1991 | Jacobson . | |
| 5,178,176 | 1/1993 | Fetterman . | |
| 5,224,506 | 7/1993 | Allen et al. . | |
| 5,238,013 | 8/1993 | Battiston et al. | 135/82 X |
| 5,353,825 | 10/1994 | Davis | 135/78 |
| 5,433,235 | 7/1995 | Miric et al. . | |

FOREIGN PATENT DOCUMENTS

| | | | |
|---|---|---|---|
| 2131683 | 6/1984 | United Kingdom | 135/86 |
| 8704920 | of 0000 | WIPO | 135/82 |

*Primary Examiner*—Carl D. Friedman
*Assistant Examiner*—Yvonne Horton-Richardson
*Attorney, Agent, or Firm*—MacMillan, Sobanski & Todd, LLC

[57] ABSTRACT

A glide cap for a walker of the type has four legs that extend into contact with the ground and support an upper handgrip portion. The glide cap encompasses at least a portion of the bottom of an elastomeric tip placed on the end of at least one of the legs of the walker. The glide cap has a hardness greater than the hardness of the elastomeric tip such that any vibration or noise caused by skidding the glide cap across a surface is dampened.

13 Claims, 2 Drawing Sheets

GLIDE CAP FOR WALKER

BACKGROUND OF THE INVENTION

The present invention relates to a glide cap for a walker.

Walkers are well known and typically include a frame that has two side pieces each of which defines a pair of parallel depending legs so the legs terminate at a lower end for contact with the ground or floor generally at the corners of a rectangle. Thus, two forward or front legs and two rear legs are defined. Each side frame portion defines a handgrip portion adjacent an upper part of the frame so the hands of the person rest upon the upper part to allow the person to move the frame forward and then to step up to the frame to assist the walking of the person.

Often the walker described above has a pair of wheels with each mounted on one of the front legs and a pair of elastomeric tips with each mounted on one of the rear legs. The frame is typically moved by skidding the rear legs across the ground while the front legs provide a rolling action.

Unfortunately, the skidding action of the rear legs creates an undesirable and bothersome chirping noise as well as vibrations that are transmitted to the hands and arms of the user. The chirping noise is produced when the elastomeric rubber tips frictionally engage and then disengage from a smooth hard surface such as tile or wood, which is commonly found in the environments where the use of walkers are prevalent, such as hospitals and nursing homes. In hospitals and nursing homes there is a continual desire to reduce noise. Thus, there has been a long standing need to solve the problem of the undesirable and bothersome chirping noise caused by moving the walker.

One solution by persons using walkers has been to create a hole in a tennis ball and then to put a leg into the tennis ball. While this temporarily solves the problem, the outer surface of the tennis ball wears and then the chirping returns. Another proposed solution is to remove the elastomeric tip and replace it with a smooth hard plastic tip. This solution, however, is not entirely satisfactory for at least two reasons. First, it requires the user to remove the elastomeric tip prior to installing hard plastic tip. This is inconvenient and often difficult for those using such walkers. Second, after a period of use, the smooth tip becomes rough, its coefficient of friction increases, and the chirping returns. Moreover, if the tip completely wears through, the metal leg end will be exposed causing it to abrade and produce the chirping noise.

SUMMARY OF THE INVENTION

The present invention solves the above problems by providing a glide cap that encompasses at least a portion of the bottom or underside end of the elastomeric tip presently provided on walkers. Importantly, the glide cap is made from a wear resistant material and has a hardness greater than the hardness of the elastomeric tip. In addition, the coefficient of friction of the glide cap is preferably less than the coefficient of friction of the elastomeric tip. Thus, the tendency of the walker to chirp is reduce and, if any chirping is produced, the presence of the elastomeric tip acts to dampen the chirping noise and vibration. Moreover, because the glide cap slides over the elastomeric tip, it can be removed during those instances when additional friction between the walker feet and the floor is desired. Advantageously, the glide cap can be used with walkers that are presently in use.

DESCRIPTION OF THE PREFERRED EMBODIMENTS

Figure 1:
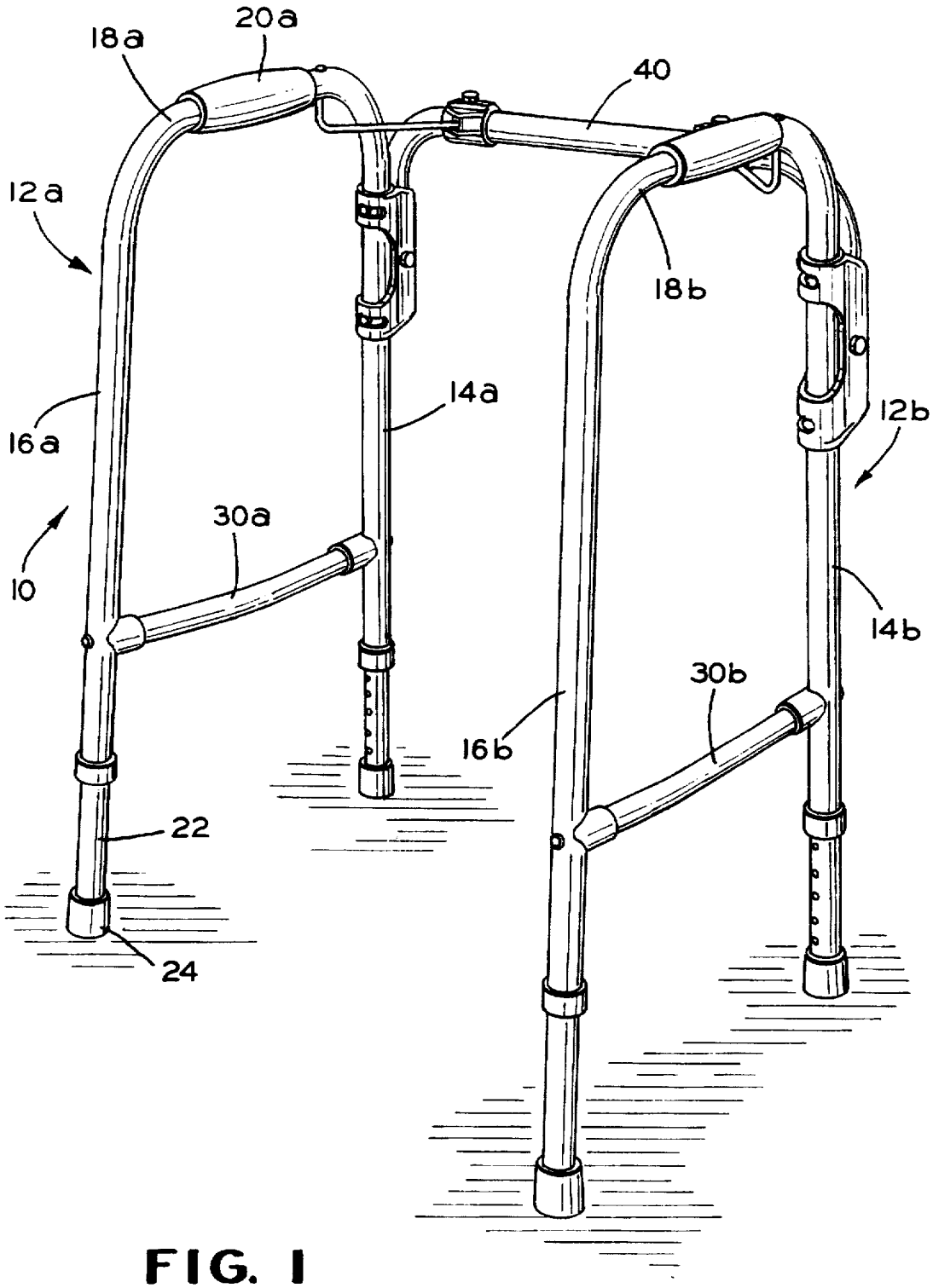
FIG. 1 (PRIOR ART)
FIG. 1 is a perspective view of a typical walker on which the glide cap of the present invention can be placed.

FIG. 1 shows a typical walker 10 that has a pair of side frames 12*a* and 12*b*. The first side frame 12*a* is generally U-shaped and inverted to define a first front leg 14*a*, a first rear leg 16*a*, and a horizontal portion 18*a*. A hand grip 20*a* may be located on the horizontal portion to provide a hand grip for the user. Likewise, the second side frame 12*b* is generally U-shaped and inverted to define a second front leg 14*b*, a second rear leg 16*b*, and a horizontal portion 18*b*.

As shown in FIG. 1, the legs terminate at a lower end and are preferably provided with an adjustable leg portion 22 having an elastomeric tip 24 that engages an underlying support surface such as the ground or floor. Generally, the tip is made from rubber or other conventional non-slip material. Preferably, the tip is made from an elastomeric material such as rubber and has a hardness in the range of about 45 to about 80 (Shore A). As used herein, rubber is defined to mean natural or synthetic rubber, such as natural rubber, polyisoprene, and other rubber-like latex materials. In addition, the tip has a coefficient of friction that provides it with excellent traction on both wet and dry surfaces. Unfortunately, since the tip has excellent traction, it will vibrate as the tip skids across the supporting surface causing undesirable noise and transmission of vibrations upward to the user's hands.

In addition, as shown in FIG. 1, the front legs 14*a* and 14*b* may be connected to the rear legs 16*a* and 16*b* by horizontal supports 30*a* and 30*b*, respectively. A cross-brace 40 connects the first front leg 14*a* to the second front leg 14*b*.

While FIG. 1 and the above description generally describes conventional walkers for which the glide cap of the present invention can be used, it will be appreciated by one of skill in the art that many modifications can be made to the walker shown in FIG. 1 without detracting from the intended use of the glide cap of the present invention. For example, the adjustable leg portion and cross-brace may be dispensed with. The cross-brace may have a shape other than substantially horizontal, e.g., it may be K-shaped, or there may be two cross-braces provided. Instead of providing a hand grip area on the horizontal portion of the side frames, hand grips can be provided that extended upward and rearward from the front legs. Typically, the tips on the terminal ends of the front legs 14*a* and 14*b* are replaced with wheels. In view of the examples of modifications described above, it is to be understood that the walker can take almost any form such that at least one leg of the walker is provided with an elastomeric tip at its terminal end.

Figure 2:
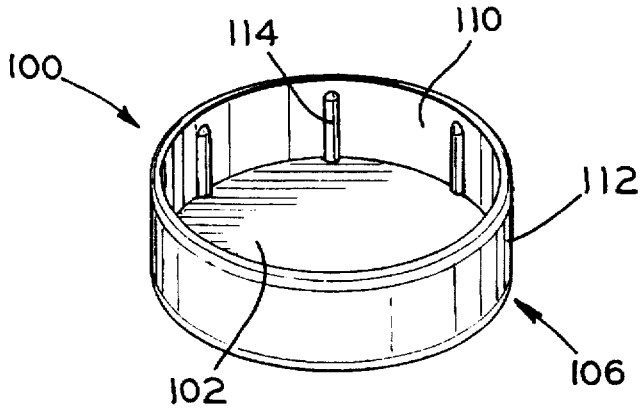
FIG. 2 is perspective view of one embodiment of the glide cap of the present invention.

Turning now to FIG. 2, the preferred embodiment of the glide cap 100 of the present invention is shown. The glide cap has an inside bottom surface 102, a bottom surface 104, and a wall 106 that extends upward from the bottom surface to define an opening 108 (best seen in FIG. 4). The wall has an inner surface 110 and an outer surface 112.

Figure 3:
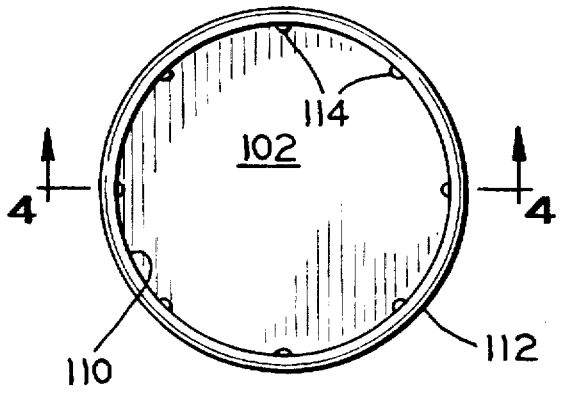
FIG. 3 is a top view of the glide cap shown in FIG. 2.
Figure 4:
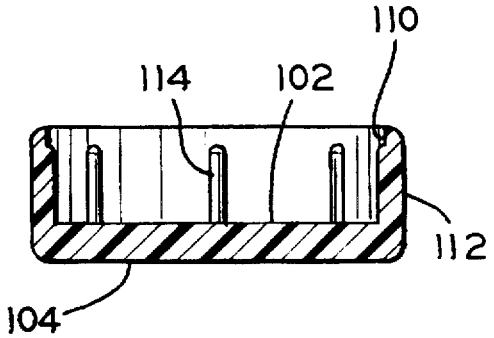
FIG. 4 is a cross-sectional view along line 4—4 of the glide cap shown in FIG. 3.

The glide cap removably engages the terminal end of the tip by inserting the tip into the opening so that the terminal end of the tip contacts the inside bottom surface and the outer surface of the tip contacts the inner surface 110 of the wall. The bottom outer surface 104 therefore engages the underlying supporting surface such as the ground or floor. The outer surface 104 is shown in FIGS. 2–4 as being closed. It is contemplated, however, that the bottom surface of the glide may have a central opening of any suitable size such that the benefits of the present invention are not detrimentally affected.

Although, in FIGS. 2–4, the glide cap has a circular shape, it is to be understood that the glide cap will have a shape to removably engage any conceivable tip shape. In addition, the wall 106 may have any desirable height, which may be dictated by manufacturing concerns as well as the goal to allow the glide cap to be removably engaged with the tip. Thus, the wall should have a height sufficient to permit the glide cap to be slidably engaged with the tip and when, in use, the glide cap will remain on the tip, as well as to allow the glide cap to be slidably removed from the tip. The wall will also have a shape such that the inner surface 110 of the wall will contact the outer surface of the tip to securely hold the glide cap in place during use. Preferably, the inner surface 110 of the wall is provided with at least one rib 114 to assist in the secure engagement of the glide cap on the tip. Alternatively, the cap could be secured to the elastomeric tip using any well known fastener such as an adhesive or mechanical fastener.

Figure 5:
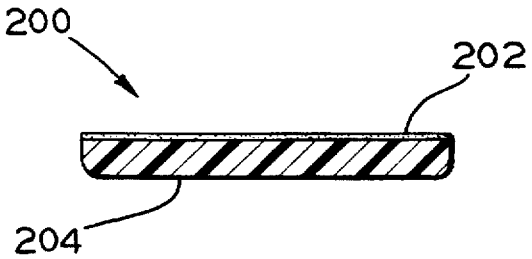
FIG. 5 is a cross-sectional view of another embodiment of the glide cap.

While the preferred embodiment of the cap is provided with an upward extending wall 112, it is contemplated that wall may be dispensed with. As shown in FIG. 5, an alternative embodiment of the glide cap 200 may consist solely of an elastomeric tip contacting portion 202 and an underlying surface portion 204, with each portion spaced apart to define a thickness of the cap. The tip contacting portion 202 may be removably secured to the underside or bottom of the elastomeric tip. In this embodiment, the cap will have a shape to substantially conform to the shape of the surface contacting portion of the elastomeric tip. Thus, where the tip is circular, as is typically the case, the cap will likewise be circular such that a tip contacting portion of the cap may be secured to the tip while the other, surface contacting portion will contact the underlying supporting surface.

In all embodiments, the glide cap is made from a material having a hardness greater than the hardness of the tip so that it has a longer wear life than the tip. Preferably, the glide cap is made from a thermoplastic such as polyethylene and has a hardness from about a Shore D value of 70 to about a Rockwell M value of about 125. By providing a glide cap having a hardness greater than the hardness of the tip, any vibration caused by skidding the glide cap across the supporting surface will be dampened by the tip.

In addition, the glide cap is made from a material that has a coefficient of friction less than the coefficient of friction of the tip. Consequently, the glide cap will be less likely to vibrate when it skids across the support surface.

In use, the glide cap is removably secured to the underside of the elastomeric tip to provide a wear resistant surface for skidding along the supporting surface. Any vibrations caused by skidding along the supporting surface will be dampened by the presence of the elastomeric tip, which will absorb the vibrations and thereby reduce any undesirable noise. Because the glide cap is removable, it can be removed when it is desired to provide additional friction between the walker and the support surface.

The present invention therefore contemplates a method of reducing or dampening the vibration caused by skidding a walker across an underlying support surface, wherein the walker has at least one leg that has an elastomeric tip on the terminal end of the leg such that the elastomeric tip has a surface contacting an underlying support surface. The method comprises removably securing a glide cap onto the underside of the elastomeric tip such that the cap is disposed between the underlying surface and the elastomeric tip, wherein the cap has a hardness greater than the hardness of the elastomeric tip. Preferably, the cap has a coefficient of friction less than the coefficient of friction of the tip.

It should be understood that a wide range of changes and modifications can be made to the embodiments described above. It is therefore intended that the foregoing description illustrates rather than limits this invention and that it is the following claims, including all equivalents, which define this invention.

What is claimed is:

1. In combination with a walker having a pair of front legs and a pair of rear legs, the legs terminating at a lower end, with at least one of the legs having an elastomeric tip on the terminal end, at least one glide cap comprising a first surface removably secured to a bottom of the elastomeric tip and a second surface adapted to contact an underlying walker support surface, wherein said glide cap is formed from a material having a hardness greater than the hardness of the tip.

2. The walker of claim 1 wherein the cap has a coefficient of friction less than the coefficient of friction of the tip.

3. The walker of claim 1 wherein each rear leg is provided with an elastomeric tip and a glide cap is provided on the elastomeric tip of each rear leg.

4. The walker of claim 3 wherein the terminal end of each front leg is provided with an elastomeric tip.

5. The walker of claim 1 wherein a wheel is provided at the terminal end of each of the front legs.

6. A removable glide cap adapted for installation on an elastomeric tip on a terminal end of a leg on a walker, said glide cap comprising a. a bottom surface formed from a material having a hardness greater than the hardness of the elastomeric tip and having a coefficient of friction less than the coefficient of friction of the elastomeric tip; and b. at least one wall extending upward from said bottom surface to define an open top sized to at least partially surround and to frictionally engage an elastomeric tip when an elastomeric tip is inserted into said open top, wherein the glide cap removably engages the tip, and wherein the glide cap bottom surface is adapted to engage an underlying support surface for a walker when installed on an elastomeric tip on a walker leg.

7. The glide cap of claim 6, wherein said at least one wall extending upwardly from said bottom surface has an interior surface adapted to abut an attached elastomeric tip, and at least one rib projecting from said interior surface to frictionally engage an elastomeric tip inserted into said open top.

8. A walker having a pair of front legs and a pair of rear legs, each leg terminating at a lower terminal end and an elastomeric tip on the terminal end of at least one of the legs, the improvement comprising at least one removable glide cap having a bottom surface adapted for engagement with an underlying supporting surface for the walker and at least one wall extending upward from the bottom surface to define an open top which at least partially surround and frictionally engages an elastomeric tip on one of said legs, wherein said glide cap is removably engaged with the elastomeric tip.

9. The walker of claim 1 wherein the cap is formed from a thermoplastic.

10. The walker of claim 9, wherein the cap is formed from polyethylene.

11. The glide cap of claim 6 wherein the cap is formed from a thermoplastic.

12. The glide cap of claim 11 wherein the cap is formed from polyethylene.

13. The glide cap of claim 8, wherein said at least one wall extending upwardly from said bottom surface has an interior surface which abuts the elastomeric tip surrounded by said open top, and at least one rib projecting from said interior surface frictionally engaging the elastomeric tip surrounded by said open top.

* * * * *